US006380898B1

(12) United States Patent
Moore et al.

(10) Patent No.: US 6,380,898 B1
(45) Date of Patent: Apr. 30, 2002

(54) DUAL MODE ANTENNA AND LAPTOP CARRYING SAME

(75) Inventors: Thomas G. Moore, Mount Prospect; Richard Kaisner, Arlington Heights, both of IL (US)

(73) Assignee: Amphenol - T&M Antennas, Vernon Hills, IL (US)

( * ) Notice: Subject to any disclaimer, the term of this patent is extended or adjusted under 35 U.S.C. 154(b) by 0 days.

(21) Appl. No.: 09/631,506

(22) Filed: Aug. 3, 2000

(51) Int. Cl.[7] ..... H01Q 1/24
(52) U.S. Cl. ..... 343/702; 343/724
(58) Field of Search ..... 343/702, 724, 343/700 MS, 900, 901; 455/90, 89

(56) References Cited

U.S. PATENT DOCUMENTS

| | | | | |
|---|---|---|---|---|
| 5,138,328 A | | 8/1992 | Zibrik et al. | 343/702 |
| D357,683 S | | 4/1995 | Cline et al. | D14/234 |
| 5,557,228 A | | 9/1996 | Kato et al. | 343/702 |
| 5,644,320 A | | 7/1997 | Rossi | 343/702 |
| 5,677,698 A | | 10/1997 | Snowdon | 343/770 |
| 5,684,672 A | | 11/1997 | Karidis et al. | 361/683 |
| 5,686,927 A | * | 11/1997 | Simmons | 343/702 |
| 5,754,141 A | * | 5/1998 | Thompson et al. | 343/702 |
| 6,046,699 A | | 4/2000 | Elliott et al. | 343/702 |
| 6,054,955 A | | 4/2000 | Schleger, Jr. et al. | 343/702 |
| 6,081,207 A | * | 6/2000 | Batio | 341/20 |

* cited by examiner

*Primary Examiner*—Don Wong
*Assistant Examiner*—James Clinger
(74) *Attorney, Agent, or Firm*—Greer, Burns & Crain, Ltd.

(57) ABSTRACT

The present invention is a dual mode antenna. The antenna of the invention connects in an inverted-F feed when in a retracted position, and in a monopole feed in an extended position. The antenna mounts adjacent a relatively large ground plane, such as a grounding shell or EMI shield included in a laptop computer display, for example. A preferred antenna includes an elongate radiator mounted in a non-conductive housing to permit retraction and extension of the elongate radiator. The housing includes electrical contact points that form an inverted-F feed antenna connection to the elongate radiator when the elongate radiator is in a retracted position. The electrical contact points form a monopole feed antenna connection to the elongate radiator when the elongate radiator is in an extended position.

8 Claims, 4 Drawing Sheets

DUAL MODE ANTENNA AND LAPTOP CARRYING SAME

FIELD OF THE INVENTION

The field of the invention is wireless signal transmission, and specifically, antennas for reception and transmission of wireless signals.

BACKGROUND OF THE INVENTION

Portable devices which rely upon wireless communication continue to proliferate. Internet access is being provided to portable organizers, for example. Devices exist to provide laptop computers with wireless Internet access through portable wireless phones. Antenna installations in devices such as laptop computers present special problems since the device interferes with signal reception and transmission.

The interference is typically caused by metal shielding that serves to reduce electromagnetic interference (EMI) introduced by the laptop into the environment. Conductive paint can serve the same function in laptop computers as metal shielding. Other portable devices use metal shielding or conductive paint for the same reason. In addition, metal is used in some portable devices to improve ruggedness of the devices.

SUMMARY OF THE INVENTION

The present invention is directed to such devices. In such a device it is desirable to have an antenna which is operable in a discreet position, i.e., one which is not extruding from the device. It is also desirable to have an antenna which can be extended away from the device to operate in conditions of weak signals, or possibly, to receive and/or transmit. Typical extendable and retractable antenna arrangements such as those used in portable phones, e.g., cellular phones, will not operate adjacent a ground plane.

The present invention is a dual mode antenna. The antenna of the invention connects in an inverted-F antenna feed when in a retracted position, and in a monopole antenna feed in an extended position. The antenna mounts adjacent a relatively large ground plane, such as a grounding shell included in a laptop computer display, for example.

A preferred embodiment antenna of the present invention includes an elongate radiator mounted in a non-conductive housing to permit retraction and extension of the elongate radiator. The housing includes electrical contact points that form an inverted-F antenna feed connection to the elongate radiator when the elongate radiator is in a retracted position. The electrical contact points form a monopole antenna feed connection to the elongate radiator when the elongate radiator is in an extended position.

In the preferred embodiment, the electrical contact points preferably include a lower contact point that connects to a lower galvanic contact near an end of the elongate radiator when the elongated radiator is retracted. The contact points also include an upper contact point that connects with a separate galvanic contact on the elongate radiator when the radiator is in the retracted position. The upper contact point connects with the lower galvanic contact when the elongate radiator is in an extended position. The upper contact point may include two separate points at which connection can be established or may define a length over which contact can be made by the lower galvanic contact such that a full extension of the elongate radiator is enabled while forming a monopole feed in the extended position.

BRIEF DESCRIPTION OF THE DRAWINGS

Other features, objects and advantages of the invention will be apparent to those skilled in the art by reference to the detailed description and the drawings, of which.

DETAILED DESCRIPTION OF THE PREFERRED EMBODIMENTS

Figure 1A:
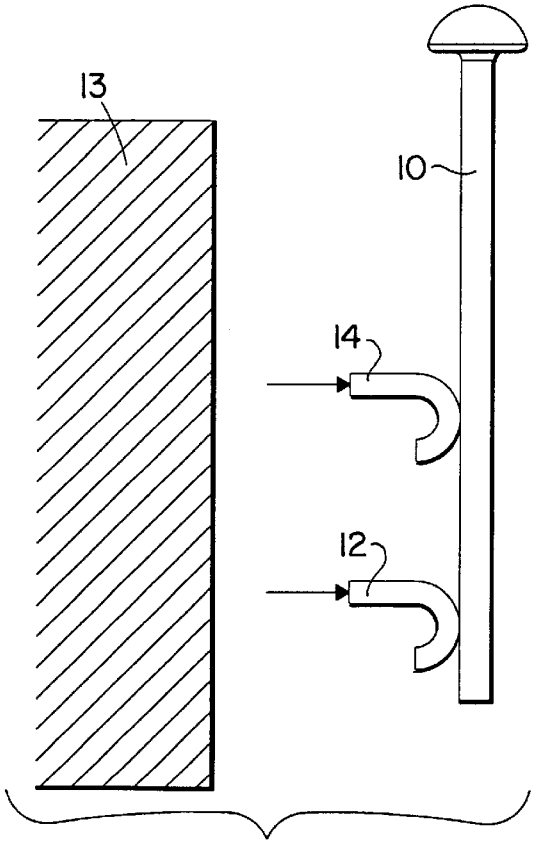
FIGS. 1*a* and 1*b* are a schematic representation of an antenna according to the invention in respective inverted-F and monopole feeds.
Figure 1B:
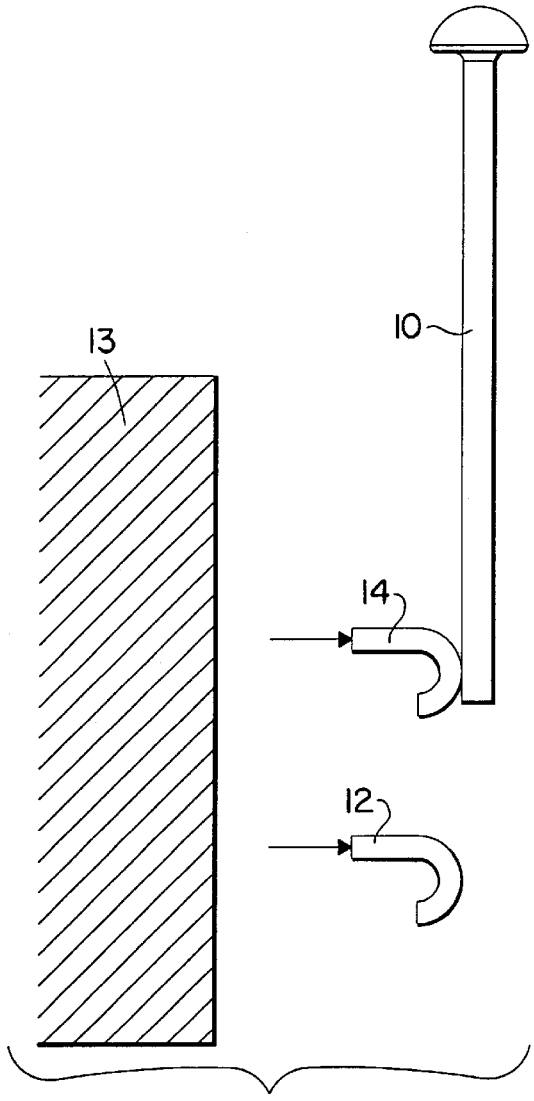

The antenna of the invention connects in an inverted-F antenna feed when in a retracted position, as represented in FIG. 1*a* and in a monopole antenna feed in an extended position, as represented in FIG. 1*b*. The antenna mounts adjacent a relatively large ground plane, such as a grounding shell or EMI shield included in the display of a laptop computer, for example. Other devices including grounding shells, EMI shields, or other parts that may serve as a ground plane may also employ the antenna of the invention.

Referring to FIGS. 1*a* and 1*b*, an elongate radiator 10 is fed at two contact points 12, 14 in tie retracted position of FIG. 1*a*. The contact points are separate, wig contact point 12 being grounded to a ground plane 13, and the separate contract point 14 being spaced apart and connected to a signal line of a device to which the antenna is attached. The signal contact point 14, or an electrical equivalent thereof, contacts the elongate radiator in FIG. 1*b* in a monopole antenna arrangement. The antenna in FIGS. 1*a* and 1*b* is held by a device portion or an attachment to a device, to permit movement of the antenna between the separate feed arrangements of FIGS. 1*a* and 1*b*. The device portion or attachment must permit radiation to impinge upon and/or be emanated from the elongate radiator in both of the inverted-F and monopole antenna feed arrangements. Thus, if the elongate radiator is enclosed in either position, then the enclosure should be nonconductive.

Figure 2:
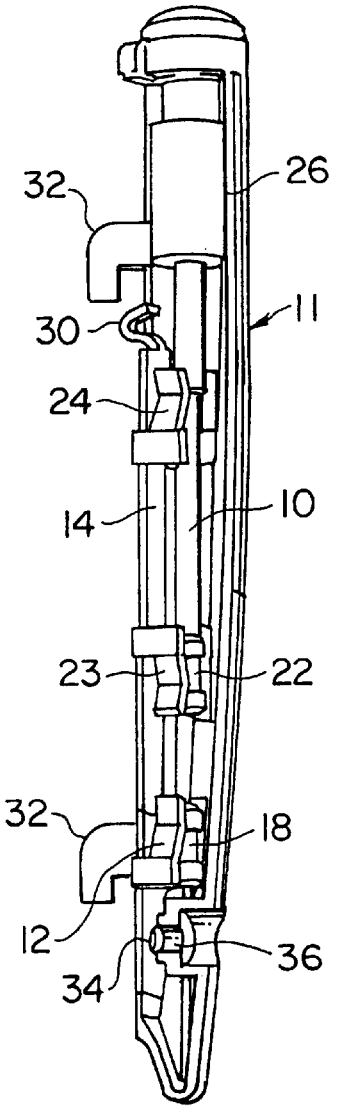
FIG. 2 illustrates a preferred embodiment antenna in a retracted position.
Figure 3:
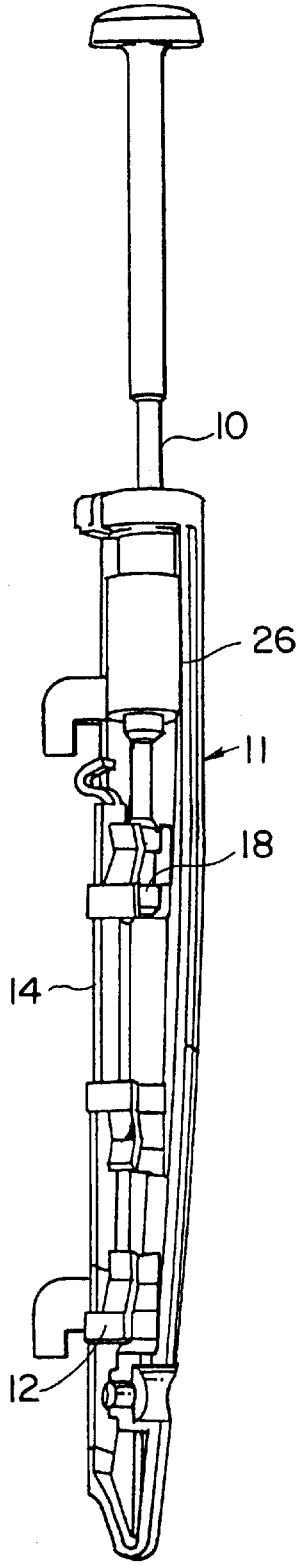
FIG. 3 illustrates a preferred embodiment antenna in an extended position.

A preferred embodiment antenna 16 of the present invention, as shown in FIGS. 2 and 3, includes an elongate radiator 10 mounted in a non-conductive housing 11 to permit retraction and extension of the elongate radiator. The housing includes electrical contact points 12 and 14 that form an inverted-F antenna feed connection to the elongate radiator 10 when the elongate radiator 10 is in the refracted position of FIG. 2. The electrical contact points 12 and 14 form a monopole antenna feed connection to the elongate radiator 10 when the elongate radiator 10 is in an extended position, i.e., no contact is made to ground plane through contact point 12. Electrical contact point 12 connects to a lower galvanic contact 18 near an end of the elongate radiator 10 when the elongate radiator 10 is retracted, but not when extended. The upper contact point 14 connects with a separate galvanic contact 22 on the elongate radiator 10 when the elongate radiator 10 is in the retracted position. To complete an inverted-F antenna configuration, the lower contact point 12 is connected to an adjacent ground plane and the upper contact point 14 to a signal line of a device with which the antenna will be used.

Figure 4:
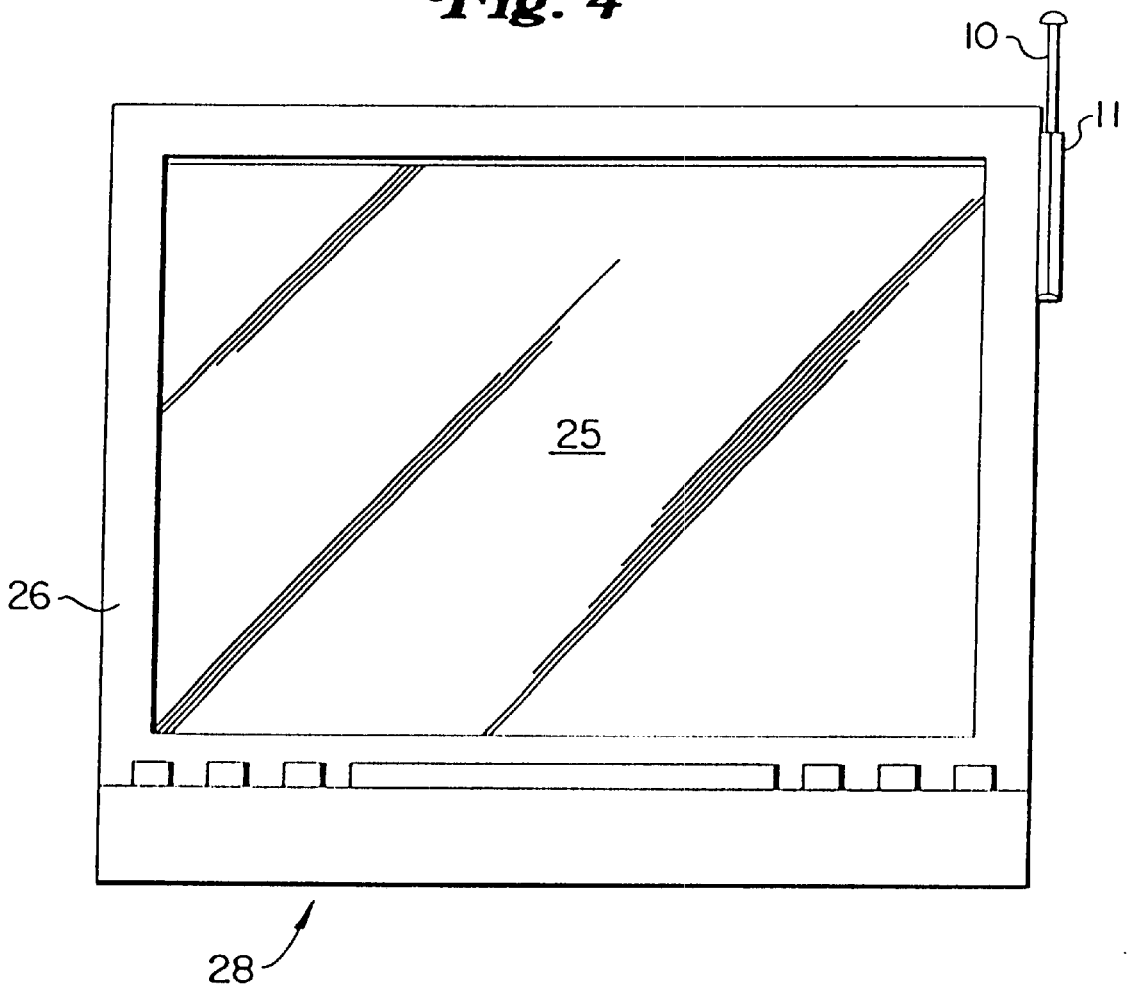
FIG. 4 illustrates a preferred antenna mounted to an exemplary device.

Movement of the elongate radiator 10 toward an extended position, shown in FIG. 3, moves the lower galvanic contact 18 out of electrical contact with the lower contact point 12. When the extension of the elongate radiator 10 brings the lower galvanic contact into electrical connection with the upper contact point 14, a monopole feed antenna is formed. The upper contact point 14 preferably includes separate feed contact points 23 and 24 to facilitate full extension of the elongate radiator 10. The upper feed contact point 24 permits extension of the elongate radiator 10 completely above a ground plane used in the retracted position of FIG. 2, as also seen in FIG. 4, which shows an antenna of the invention having its elongate radiator 10 extended above a device 25, which may be a laptop computer. The feed contact points 23 and 24 are electrically equivalent, but mechanically separate. Depending on a device application, the feed contact points 23 and 24 may also be electrically distinct. The upper contact point 14 might also define a length over which contact can be made by the lower galvanic contact such that a full extension of the elongate radiator is enabled while forming a monopole feed in the fully extended position and any partially extended position in which the upper contact point 14 is contacted by the lower galvanic contact 18.

The retracted and extended positions in FIGS. 2 and 3 are preferably facilitated by mechanical relationships between the lower contact point 12 and the feed contact points 23 and 24 with at least the lower galvanic contact 18. The upper galvanic contact 22 may Pa also help to define stop points for retraction and extension of the elongate radiator 10, and 13 should be used to define an uppermost point of extension. As seen in FIG. 3, the upper galvanic contact 22 is prevented from passing through a restricted portion 26 of the housing 11. Ends of the lower galvanic contact 18 and the upper galvanic contact 22 are preferably rounded or tapered on both ends to allow smooth passing into and out of contact with the lower contact point 16 and/or the upper feed contact points 23 and 24, as well as the restricted portion 26.

Referring again to FIG. 4, the placement on a display part 26 of the laptop computer 25 is permitted by the inverted-F operation of the present antenna. The limitation on placement and orientation of the antenna is that it cannot be perpendicular to a ground plane such as that would typically be formed by a display portion of a laptop computer. Optimum operation will occur when the antenna 10 is generally in the same plane as a ground plane included in the display part 26 of the laptop computer 25 having the display part 26 and a keyboard part 28. The antenna should be high enough on the display part 26 to permit extension above the display part (as pictured in FIG. 4, which shows a monopole feed position for in which the elongate radiator 10 extends above the display part 26). If the antenna is mounted lower, the ground plane will interfere with the antenna pattern in a monopole feed arrangement.

Referring again to FIGS. 2 and 3, certain mechanical features of the preferred antenna facilitate reliable mounting with a device, such as the laptop computer 25 in FIG. 4. The upper feed contact point 14 preferably includes a flexible portion 30 which will make contact with a device signal feed when hooks 32 are interlocked with a portion of a device by insertion into a slot and lateral movement which aligns the flexible portion 30 to engage a corresponding hole or depression on the device. A lower portion 34 of the lower contact point 12 could have a similar flexible portion, or, as in FIGS. 2 and 3, may have a hole into which a conducting screw, lock pin or other mechanical engagement can make electrical and mechanical contact with a ground contact of the device. Alternative arrangements include, but are not limited to, formation of the antenna housing as an integral part of the device housing. Thus, for example, an antenna of the invention might be molded into the plastic surrounding a display in a laptop computer.

Figure 5:
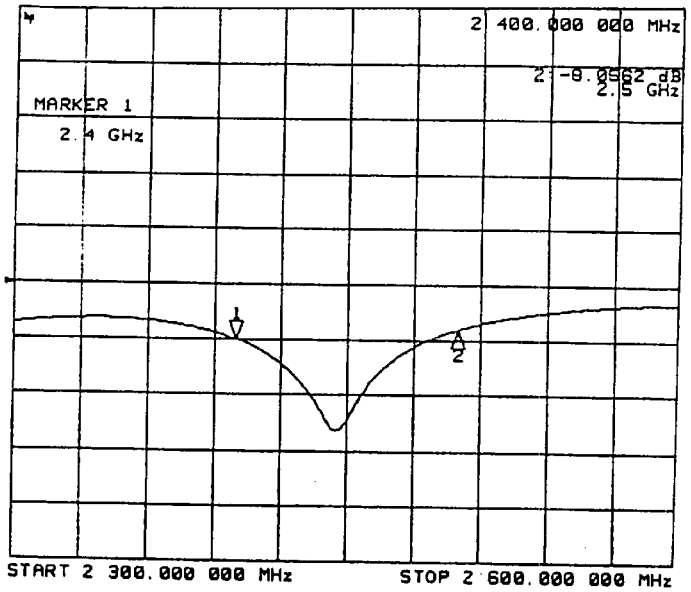
FIG. 5 is a graph of return loss for a prototype antenna of the invention operating in an inverted-F retracted position when mounted alongside the display of a laptop computer for the 2.4 GHz (Blue Tooth) band.
Figure 6:
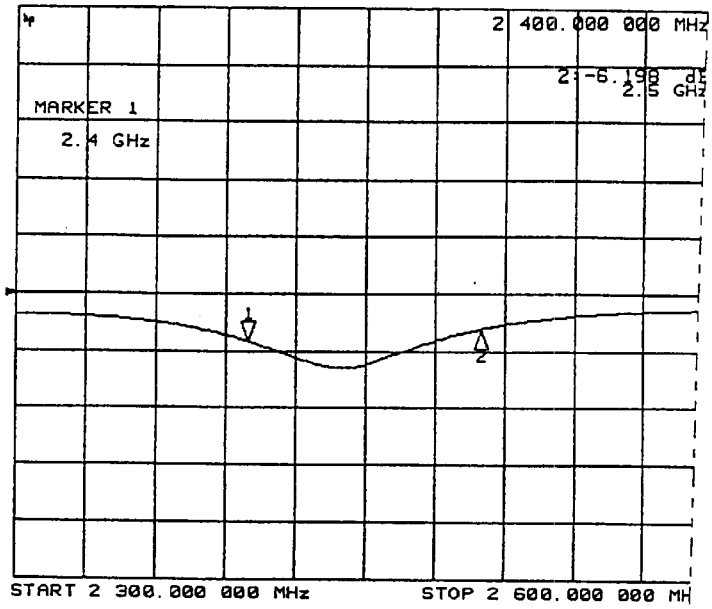
FIG. 6 is a graph of return loss for the prototype antenna of the invention measured in FIG. 5, but operating in a monopole extended position and in the 2.4 GHz (Blue Tooth) band.

A prototype antenna of the invention has been tested with a laptop computer arranged in the FIG. 4 embodiment. Return loss was measured for the 2.4 GHz (Blue Tooth) band in both retracted (inverted-F) and extended (monopole) operation. Return loss for the retracted inverted-F operation is shown in FIG. 5. Return loss for the extended monopole operation is shown in FIG. 6. Besides the good return loss data, the antenna of the invention exhibited additional characteristics that make it well suited to use in a laptop. The inverted-F pattern provides optimum coverage when the laptop is closed. The monopole is optimized when the laptop was open.

While various embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the appended claims.

What is claimed is:

1. A dual mode antenna for use with a device including a conducting ground plane, the antenna comprising:

an elongate radiator;

a non-conductive housing, the housing permitting retraction and extension of said elongate radiator over a limited range of movement;

separate galvanic contact elements spaced apart on said elongate radiator and in electrical contact with said elongate radiator;

a ground plane galvanic contact point associated with said housing and located to electrically contact a lower one of said separate galvanic contact elements when said elongate radiator is in a retracted position; and a signal galvanic contact point associated with said housing and spaced apart from said ground plane galvanic contact to electrically contact an upper one of said separate galvanic contact elements when said lower one of said separate galvanic contact elements is in electrical contact with said ground plane galvanic contact point to thereby form an inverted-F feed antenna arrangement, wherein extension of said elongate radiator to separate said lower galvanic contact from said lower galvanic contact permits at least one of said separate galvanic contact elements to electrically contact said signal galvanic contact point and therefore form a monopole antenna arrangement.

2. The dual mode antenna according to claim 1, wherein said signal galvanic contact point is disposed to electrically contact said lower one of said separate galvanic contact elements when said elongate radiator is in a fully extended position.

3. The dual mode antenna according to claim 2, wherein said signal galvanic contact point includes separate feed contact points, a lower one of said feed contact points being disposed to electrically contact said upper one of said separate galvanic contact elements when said lower one of said separate galvanic contact elements is in electrical contact with said ground plane galvanic contact point, and an upper one of said feed contact points being disposed to contact said lower one of said separate galvanic contact elements when said elongate radiator is in the fully extended position.

4. A dual mode antenna for use with a device including a conducting ground plane, the antenna comprising:

an elongate radiator;

a non-conductive housing, the housing permitting retraction and extension of said elongate radiator over a limited range of movement;

separate galvanic contact elements spaced apart on said elongate radiator and in electrical contact with said elongate radiator;

electrical contact points associated with said housing and disposed to form an inverted-F feed antenna arrangement with said separate galvanic contact elements when said elongate radiator is in a retracted position and to form a monopole feed antenna arrangement when said elongate radiator is in an extended position.

5. The dual mode antenna according to claim 4, wherein said elongate radiator forms a quarter wave radiator in said monopole feed arrangement.

6. The dual mode antenna according to claim 5, wherein said housing is formed as a portion of the device including the conducting ground plane.

7. A dual mode antenna for use with a device including a conducting ground plane, the antenna comprising:

an elongate radiator;

a non-conductive housing, the housing permitting retraction and extension of said elongate radiator over a limited range of movement;

electrical contact points associated with said housing and disposed to form an inverted-F antenna feed connection to said elongate radiator when said elongate radiator is in a retracted position and to form a monopole antenna feed connection to said elongate radiator when said elongate radiator is in an extended position.

8. A laptop computer, the computer comprising:

a display part including a conductive ground plane;

a keyboard part;

an antenna mounted on the display part and adjacent the conductive ground plane, the antenna comprising an elongate radiator;

a non-conductive housing, the housing permitting retraction and extension of said elongate radiator over a limited range of movement;

electrical contact points associated with said housing and disposed to form an inverted-F antenna feed connection to said elongate radiator when said elongate radiator is in a retracted position and to form a monopole antenna feed connection to said elongate radiator when said elongate radiator is in an extended position.

* * * * *